US009655479B2

(12) United States Patent
Tederous et al.

(10) Patent No.: US 9,655,479 B2
(45) Date of Patent: May 23, 2017

(54) TWO-LIQUID DISPENSING SYSTEMS, REFILLS AND TWO-LIQUID PUMPS

(71) Applicants: Cory J. Tederous, Stow, OH (US); Nick E. Ciavarella, Seven Hills, OH (US)

(72) Inventors: Cory J. Tederous, Stow, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 507 days.

(21) Appl. No.: 13/787,326

(22) Filed: Mar. 6, 2013

(65) Prior Publication Data

US 2014/0197196 A1 Jul. 17, 2014

Related U.S. Application Data

(60) Provisional application No. 61/752,686, filed on Jan. 15, 2013.

(51) Int. Cl.
*A47K 5/14* (2006.01)
*A47K 5/12* (2006.01)
(Continued)

(52) U.S. Cl.
CPC ..... *A47K 5/14* (2013.01); *A47K 5/1207* (2013.01); *A47K 5/1208* (2013.01);
(Continued)

(58) Field of Classification Search
CPC ..... B05B 11/3084; B01F 15/0085; B01F 15/0087; B01F 15/0237; B01F 15/029; A47K 5/14; A47K 5/1207; A47K 5/1208
(Continued)

(56) References Cited

U.S. PATENT DOCUMENTS 3,760,986 A * 9/1973 Castner ..... B05B 11/0056 222/137
4,949,874 A * 8/1990 Fiedler ..... A47K 5/1201 222/135
(Continued)

FOREIGN PATENT DOCUMENTS

DE 19738039 A1 3/1999
EP 1806216 A2 7/2007
(Continued)

OTHER PUBLICATIONS

International Search Report and Written Opinion from International Application No. PCT/US2013/025855, date of mailing Dec. 20, 2013.
(Continued)

*Primary Examiner* — Charles P Cheyney
(74) *Attorney, Agent, or Firm* — Calfee, Halter & Griswold LLP

(57) ABSTRACT

Exemplary embodiments of dispensing systems for dispensing mixtures of multiple liquids, refill units and pumps for such refill units and dispensers are disclosed herein. One refill unit includes a first container and a second container. The refill unit includes a first pump chamber that is associated with the first container and a second pump chamber that is associated with the second container. The first and second pump chambers include a liquid inlet valve and a liquid outlet valve. Expanding the first and second pump chambers draws liquid into the first and second pump chambers through the liquid inlet valves and compressing the first and second pump chambers forces liquid through the liquid outlet valves into a mixing chamber located downstream of the liquid outlet valves. The mixing chamber is formed at least in part by a flexible membrane. The refill unit also includes an outlet nozzle for dispensing the mixture.

9 Claims, 4 Drawing Sheets

(51) Int. Cl.
*B01F 15/02* (2006.01)
*B01F 15/00* (2006.01)

(52) U.S. Cl.
CPC ..... *B01F 15/0085* (2013.01); *B01F 15/0087* (2013.01); *B01F 15/029* (2013.01); *B01F 15/0237* (2013.01)

(58) Field of Classification Search
USPC ..... 222/190, 129, 136, 145.5, 145.1, 145.4, 222/145.6, 137, 207, 252, 255
See application file for complete search history.

(56) References Cited

U.S. PATENT DOCUMENTS 5,197,637 A 3/1993 Naumann
5,339,990 A * 8/1994 Wilder ..... 222/135
5,353,961 A * 10/1994 Debush ..... B65D 25/08 206/221
5,385,270 A * 1/1995 Cataneo ..... B05B 11/3083 222/134
5,398,845 A 3/1995 Meyer
5,464,125 A 11/1995 Daansen
5,544,788 A 8/1996 Meyer
5,560,545 A * 10/1996 Grogan ..... B05B 7/0408 222/136
5,711,457 A * 1/1998 Wanbaugh ..... B05B 11/3085 222/136
5,848,732 A * 12/1998 Brugger ..... B05B 11/3083 222/137
5,860,569 A * 1/1999 Gregoire ..... B65D 25/087 222/129
5,881,919 A 3/1999 Womac et al.
5,971,210 A 10/1999 Brugger
6,189,740 B1 2/2001 Wade et al.
6,299,023 B1 10/2001 Arnone
6,454,135 B1 * 9/2002 Brozell ..... 222/135
6,464,107 B1 * 10/2002 Brugger ..... 222/134
6,764,467 B1 * 7/2004 Roby ..... A61B 17/00491 222/129
7,281,643 B2 10/2007 Lin
7,306,119 B2 12/2007 Wootton
7,510,101 B2 3/2009 Foster
8,002,151 B2 * 8/2011 Matthews et al. ..... 222/190
8,083,103 B2 * 12/2011 LaFlamme et al. ..... 222/135
8,276,784 B2 10/2012 Ciavarella et al.
8,616,414 B2 * 12/2013 Ciavarella ..... 222/190
2005/0271599 A1 12/2005 Matthews et al.
2006/0114745 A1 6/2006 Ollmann et al.
2007/0184010 A1 8/2007 Herlands
2008/0035673 A1 2/2008 Malik et al.
2008/0272148 A1 11/2008 Malik et al.
2008/0277421 A1 11/2008 Zlatic
2009/0277928 A1 11/2009 Bruckner
2009/0294477 A1 12/2009 Ciavarella et al.
2009/0308890 A1 12/2009 Saravis
2009/0317270 A1 12/2009 Reynolds
2010/0051642 A1 3/2010 Wong
2010/0091478 A1 4/2010 Miller
2011/0101031 A1 5/2011 Hagleitner
2011/0251277 A1 10/2011 Matthews
2012/0160879 A1 * 6/2012 Ciavarella et al. ..... 222/409

FOREIGN PATENT DOCUMENTS

EP 2006026 A2 12/2008
GB 2293157 A 3/1996

OTHER PUBLICATIONS

International Search Report and Written Opinion from International Application No. PCT/US2014/010008, date of mailing May 19, 2014.

* cited by examiner

TWO-LIQUID DISPENSING SYSTEMS, REFILLS AND TWO-LIQUID PUMPS

RELATED APPLICATIONS

This non-provisional utility patent application claims priority to and the benefits of U.S. Provisional Patent Application Ser. No. 61/752,686 filed on Jan. 15, 2013 and entitled TWO-LIQUID DISPENSING SYSTEMS, REFILLS AND TWO-LIQUID PUMPS. This application is incorporated herein by reference in its entirety.

TECHNICAL FIELD

The present invention relates generally to multiple liquid dispensing systems, refill units for dispensing systems and pumps for multiple liquid dispensing systems.

BACKGROUND OF THE INVENTION

Liquid dispensing systems, such as liquid soap and sanitizer dispensers, provide a user with a predetermined amount of liquid upon actuation of the dispenser. In addition, it is sometimes desirable to dispense the liquid in the form of foam. Foam is generally made by injecting air into the liquid to create a foamy mixture of liquid and air bubbles.

SUMMARY

Exemplary embodiments of dispensing systems for dispensing mixtures of multiple liquids, refill units and pumps for such refill units and dispensers are disclosed herein. One exemplary refill unit includes a first container and a second container. In addition, the refill unit includes a first pump chamber that is associated with the first container and a second pump chamber that is associated with the second container. The first and second pump chambers include a liquid inlet valve and a liquid outlet valve. Expanding the first and second pump chambers draws liquid into the first and second pump chambers through the liquid inlet valves and compressing the first and second pump chambers forces liquid out through the liquid outlet valves into a mixing chamber located downstream of the liquid outlet valves. The mixing chamber is formed at least in part by a flexible membrane. The refill unit also includes an outlet nozzle located downstream of the mixing chamber.

Another exemplary refill unit for a foam dispenser includes a first container and a second container. The first container includes a first outlet associated therewith. Similarly, the second container includes a second outlet associated therewith. The refill unit includes a bellows style mixing chamber located downstream of the first and second outlets. At least one inlet valve is associated with the first outlet and the second outlet to allow liquid to flow from the first and second containers into the bellows style mixing chamber. The refill unit also includes an outlet valve and outlet nozzle located downstream of the bellows style mixing chamber.

Another exemplary refill unit includes a first container holding a first liquid and a second container holding a second liquid. A first outlet is associated with the first container and a second outlet is associated with the second container. The refill unit also includes a variable volume mixing chamber located downstream of the first outlet and the second outlet. At least one inlet valve is associated with the first outlet and the second outlet to allow liquid to flow from the first and second containers into the variable volume mixing chamber. Mixing the first liquid with the second liquid causes the mixture of the first liquid and the second liquid to form a foam. The refill unit also includes an outlet nozzle located downstream of the variable volume mixing chamber. Compressing the variable volume mixing chamber forces the foam mixture out of the outlet nozzle.

Exemplary foam dispensers that include a carrier for holding a first container and a second container are also disclosed. One embodiment includes a first container holding a first liquid and the second container holding a second liquid that is different from the first liquid. The first container and the second container are secured to and in fluid communication with a variable volume mixing chamber. An actuator is included for expanding and contracting the volume of the variable volume mixing chamber. Expanding or contracting the variable volume mixing chamber toward a first volume causes liquid from the at least two containers to enter the variable volume mixing chamber. When the liquids from the first and second containers mix together, they form a mixture that expands to form a foam that is dispensed out of an outlet nozzle.

BRIEF DESCRIPTION OF THE DRAWINGS

These and other features and advantages of the present invention will become better understood with regard to the following description and accompanying drawings in which.

DETAILED DESCRIPTION

Figure 1:
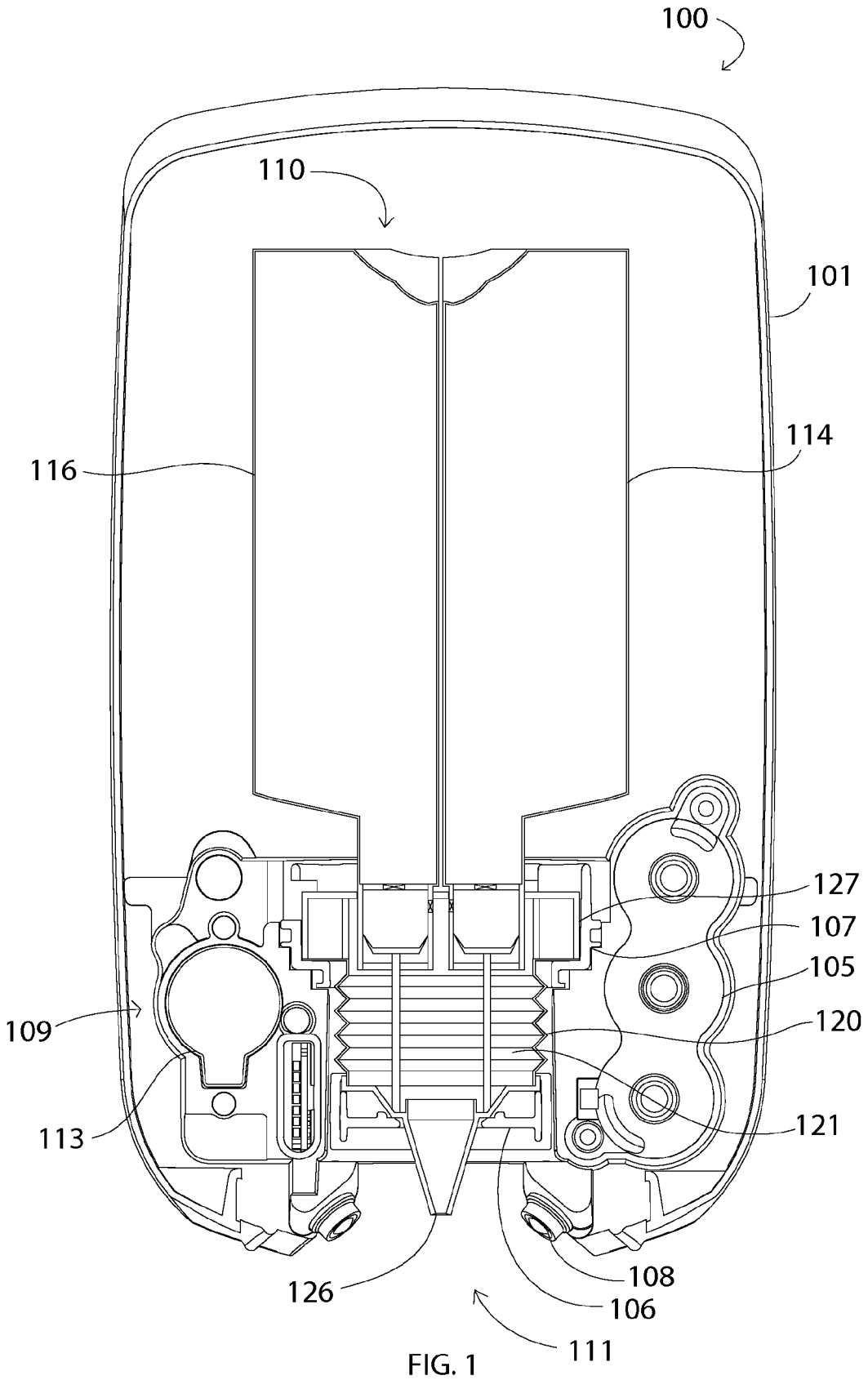
FIG. 1 is a cross-sectional view of an exemplary embodiment of a foam dispensing system 100.

FIG. 1 is a cross-sectional view of an exemplary dispenser 100 for mixing and dispensing multiple liquids. The exemplary dispenser disclosed and described herein is an electrically-operated, touch-free dispenser 100; however, other types of dispensers may be used, such as, for example, manually-operated dispensers. Manual dispensers may be actuated with a push bar, a lever, a pull actuator or the like. Dispenser 100 includes housing 101. Located within housing 101 is power supply 105. Power supply 105 may be a 6 VDC power supply, such as, for example, a plurality of batteries. Optionally, power supply 105 may be a transformer and/or rectifier if the dispenser 100 is connected to, for example, a 120 VAC power source.

Dispenser 100 also includes a holder 107 for receiving a refill unit 110. Holder 107 may include a retention mechanism, such as, for example, a rotatable lock ring (not shown) that rotates to engage and disengage with refill unit 110. In such a case, pump housing 127 of refill unit 110 may include engagement tabs (not shown) to releasably interlock with a rotatable lock ring.

Housing 101 includes an actuator 106 movable up and down by a motor 113 and associated gearing to dispense a dose of a mixture of two or more liquids from refill unit 110 as described in more detail below. In addition, housing 101 includes associated circuitry for using a sensor 108 to detect an object and to cause actuator 106 to operate and dispense a dose of foam onto the object.

Refill unit 110 includes a first container 114 for holding a first liquid and a second container 116 for holding a second liquid. In some embodiments, additional containers for holding additional liquids may be included. Accordingly, some exemplary dispensers and refill units mix and dispense mixtures of more than two liquids. First container 114 and second container 116 are secured to pump housing 127. Also secured to pump housing 127 is a flexible membrane 120, which is illustrated as a bellows and forms a mixing chamber 121. However, mixing chamber 121 may be any type of chamber that has a variable volume. It may be made of an elastomeric material that stretches and compresses. Secured to flexible membrane 120 is an outlet nozzle 124.

FIGS. 2-5 below provide additional details of exemplary multiple-liquid dispensing systems. Certain of the embodiments require different directions of actuator 106 movement to operate. For example, one refill unit and pump disclosed herein may cause liquid to be pumped into the mixing chamber by moving the actuator upward, while another may cause liquid to be pumped into the mixing chamber by moving the actuator downward. This may be readily accomplished through software programming and/or hardware changes. In addition, the dosing sizes may be altered by programming different actuation stroke lengths of the actuators. Accordingly, these pumps are also variable dosing pumps.

Figure 2:
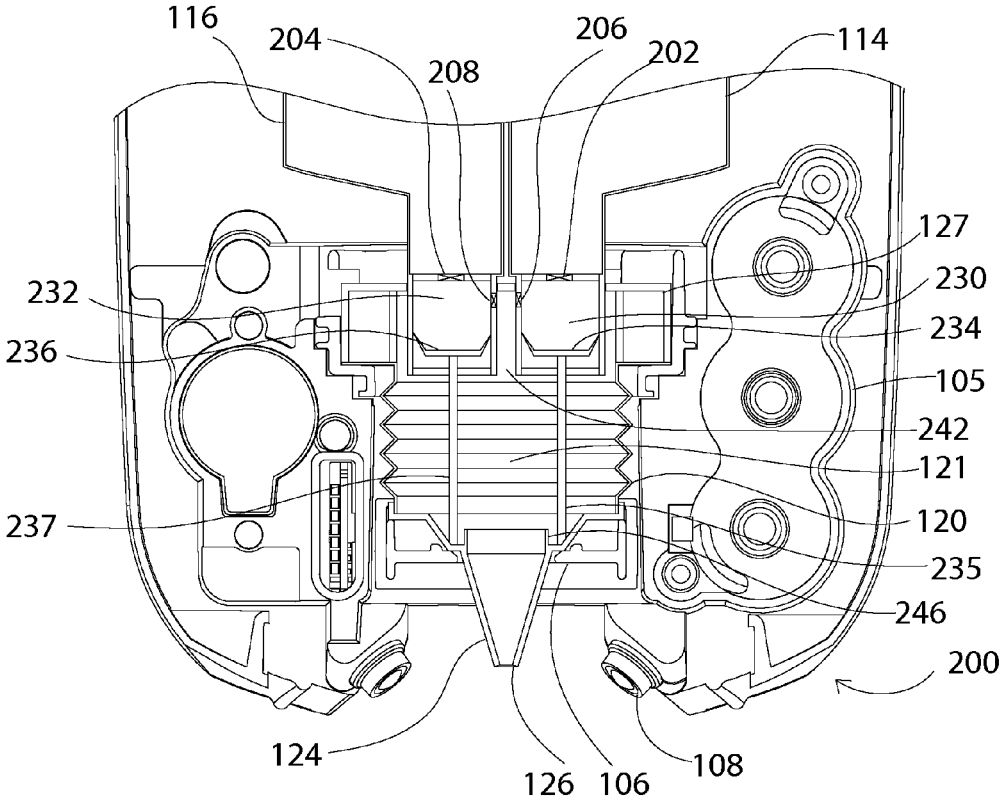
FIG. 2 is an enlarged cross-sectional view of the exemplary foam dispensing system and refill unit of FIG. 1 illustrated in a primed or priming position.
Figure 3:
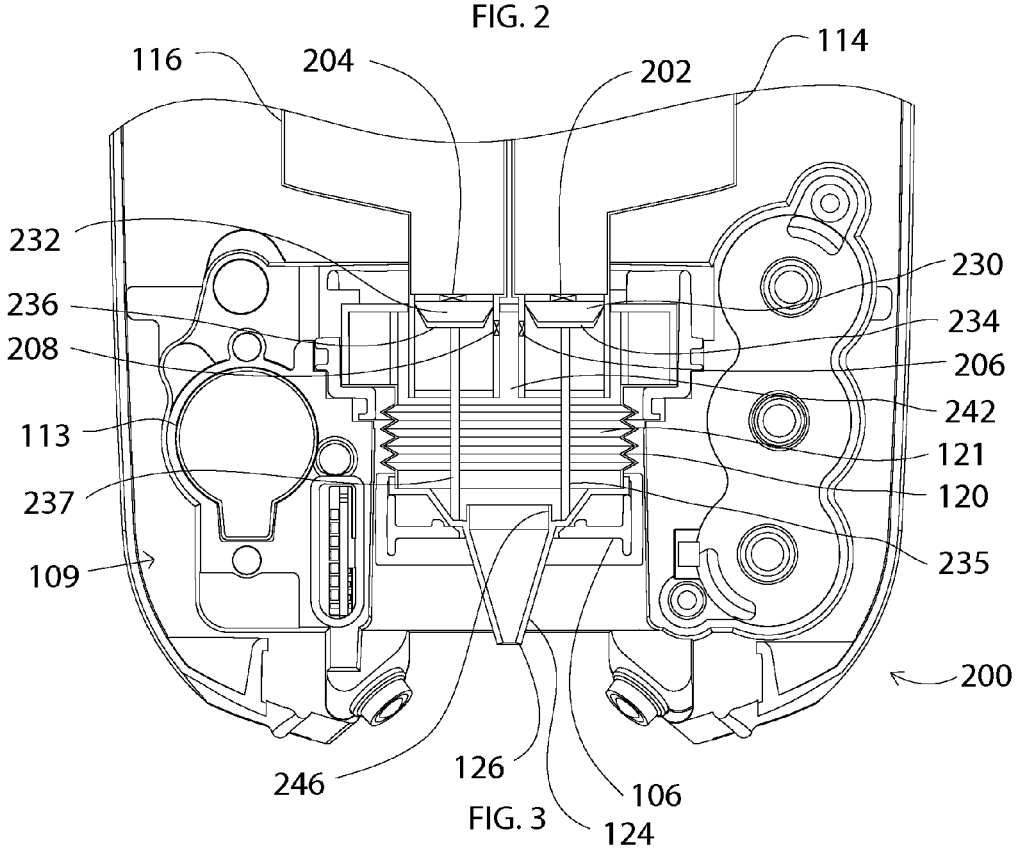
FIG. 3 is an enlarged cross-sectional view of the exemplary foam dispensing system and refill unit of FIG. 1 illustrated in a discharged position.

FIGS. 2 and 3 are enlarged cross-sectional areas of the pumping portion shown in dispenser 100. FIG. 2 illustrates a dispensing system 200 in a primed or charged state with the mixing chamber 121 fully expanded. FIG. 3 illustrates the dispensing system 200 in a discharged state with the mixing chamber 121 fully collapsed. Although the figures illustrate the pumping system at its extreme stroke for dispensing a full dose, the exemplary pumps described herein may be operated on a stroke that is a fraction of the total stroke for a reduced dose output.

Dispensing system 200 includes a first pump chamber 230 in fluid communication with first container 114 and a second pump chamber 232 in fluid communication with second container 116. First pump chamber 230 includes a liquid inlet valve 202. Similarly, second pump chamber 232 includes a liquid inlet valve 204. In addition, first pump chamber 230 includes a liquid outlet valve 206 and second pump chamber 232 includes a liquid outlet valve 208. The one-way inlet and outlet valves described herein may be any type of one-way valve, such as, for example, a mushroom valve, a flapper valve, a plug valve, an umbrella valve, a poppet valve, a duck-bill valve, etc. The liquid inlet valves 202, 204 are located in the upper wall that separates pump chambers 230, 232 from their respective containers 114, 116. Liquid outlet valves 206, 208 are located in an upper side wall of their respective pump chambers 230, 232.

In some embodiments, the liquid outlet valves 206, 208 are positioned so that liquid flowing out of the liquid outlet valve 206 strikes liquid flowing out of liquid outlet valve 208. The liquid flowing out of the liquid outlet valves 206, 208 begins mixing in passage 242. In some embodiments, passage 242 is narrow to cause the liquids to mix more forcefully. In some embodiments, passage 242 is wider to prevent clogging of the passage 242. Located at least partially within first pump chamber 230 is a piston 234. Piston 234 includes a piston shaft 235 that is used to move piston 234 up and down within pump chamber 230. Similarly, located at least partially within second pump chamber 232 is piston 236. Piston 236 includes a piston shaft 237 that is used to move piston 236 up and down within pump chamber 232.

A flexible membrane 120, in the shape of a bellows, is secured to pump housing 127. The flexible membrane 120 compresses and stretches to form a variable volume mixing chamber 121. In some embodiments, the compressing and stretching prevents liquid residue from adhering to and building up on the interior of flexible membrane 120. Secured to flexible membrane 120 is an outlet nozzle 124, which includes an outlet 126. In some embodiments, outlet nozzle 124 has a conical shape. In some embodiments, outlet nozzle 124 is very narrow to promote additional mixing of the two or more liquids to enhance the quality of the foam output.

In addition, dispensing system 200 includes a drip catcher 246. Drip catcher 246 is an annular projection that projects upward within variable volume mixing chamber 121. Drip catcher 246 catches any residual liquid or foam that travels down the walls of flexible membrane 120 after the dispense cycle has been completed and the object has been removed from underneath nozzle outlet 126.

Dispensing system 200 is shown in its fully primed and resting state in FIG. 2. During operation, upon detecting an object through sensor 108 under dispensing system 200, circuitry 109 causes motor 113 and associated gearing to move actuator 106 upward. Movement of actuator 106 upward compresses mixing chamber 121 and moves pistons 234, 236 upward. Movement of piston 234 upward causes liquid in pump chamber 230 to be expelled through outlet valve 206. Simultaneously, movement of piston 236 upward causes liquid in second pump chamber 232 to be expelled out through outlet valve 208. The two liquids collide together and begin mixing in passage 242.

In one embodiment, the first liquid includes weak acid and the second liquid includes a weak base. When the two liquids combine, a gas is formed, and the mixture expands. In addition, one or both of the liquids may contain a wax. The gas created by the combination of the two liquids mixes with, and is trapped in, the wax and forms a thick foam. Other additives may be included. The thick foam may be a soap, sanitizer or lotion. The reaction continues even after the actuator 106 fully compresses the variable volume mixing chamber 121 and first and second pump chambers 230, 232, as shown in FIG. 3.

After a sufficient time passes for the thick foam to be dispensed out of nozzle outlet 126, the actuator 106 moves downward. The flexible membrane 120 acts as a biasing member and expands the variable volume mixing chamber 121 back to its original state. Optionally, a separate biasing member (not shown), such as, for example a spring, may move the variable volume mixing chamber 121 back to its original state. In some embodiments, actuator 106 is connected to outlet nozzle 124 and is used to expand the variable volume mixing chamber 121 during its return stroke.

Pistons 234 and 236 also move downward to expand pump chambers 230, 232 respectfully. In some embodiments, piston shafts 235, 237 are secured to outlet nozzle 124 and move outward with outlet nozzle 124. Optionally, separate biasing members may be used to move pistons 234 and 236 downward. As pistons 234, 236 move downward, liquid outlet valves 206, 208 close and liquid inlet valves 202, 204 open to allow liquid to flow into liquid pump chambers 230, 232 to recharge them. In addition, as the volume of variable volume mixing chamber 121 increases, any residual liquid or foam in the outlet nozzle 124 is drawn back up into the variable volume mixing chamber 121, which may prevent leakage after the object is removed.

Various configurations of the foam dispensers and refill units and various combinations of the components are within the scope of the present invention. For example, the dispenser may include the variable volume mixing chamber permanently secured to it and the refill units may be two separate containers, or a single unit divided into two containers that releasably connect to the variable mixing chamber of the dispenser.

Figure 4:
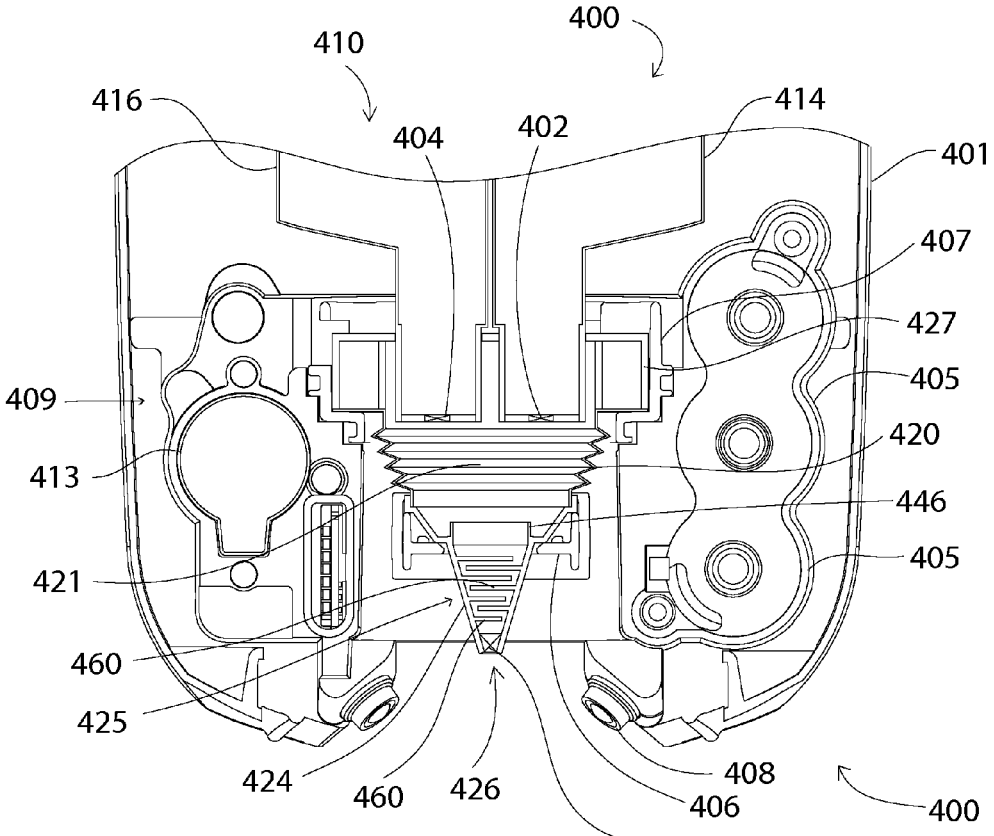
FIG. 4 is an enlarged cross-sectional view of another exemplary dispensing system and refill unit.

FIG. 4 is an enlarged cross-sectional view of another exemplary dispensing system 400. Dispensing system 400 is similar to dispensing system 200 and may be used in a similar dispenser with minor software/hardware modifications. Dispensing system 400 includes a housing 401, a holder 407 for holding a refill unit, a power supply 405, a sensor 408 for sensing an object, a motor 413 and associated gearing, an actuator 406 and circuitry 409 for determining when an object is present and causing the motor 413 to operate actuator 406 to dispense a dose of the mixture of two or more liquids. As discussed above, holder 407 may include a means, such as for example, a rotatable lock ring, for securing a refill unit 410 to dispenser housing 401.

A refill unit 410 is inserted in dispensing system 400. Refill unit 410 includes a first container 414, a second container 416, a flexible membrane 420, an outlet nozzle 424 and a outlet 426. In some embodiments, flexible membrane 420 is in the form of a bellows. In some embodiments, the flexible membrane 420 forms a conical shape or a tapered shape as illustrated in FIG. 4.

A variable volume mixing chamber 421 is formed at least in part by flexible membrane 420. In addition, located between first container 114 and variable volume mixing chamber 421 is a liquid inlet valve 402. Similarly, located between second container 616 and variable volume mixing chamber 421 is liquid inlet valve 404. Secured to flexible membrane 420 is outlet nozzle 424. Outlet nozzle 424 includes a conical outlet portion 425. In some embodiments, the conical outlet portion 425 includes one or more baffles 460 that cause turbulence to the liquids passing through and vigorously mixes the liquids together to increase the reaction occurring between the liquids. In addition, outlet nozzle 424 includes a one-way outlet check valve 445 located near the outlet 426.

During operation, if control circuitry 409 detects an object through sensor 408, the control circuitry 409 causes the motor 413 to move actuator 406 (which in its normal rest position is at the top of its stroke) downward. As actuator 406 moves downward, variable volume mixing chamber 421 expands. Variable volume mixing chamber 421 may expand due to the bias caused by resiliency of the flexible membrane 420 (if for example it has a bellows shape), by an additional biasing member (not shown), or by securing the outlet nozzle 424 to the actuator 406. As the variable volume mixing chamber 421 expands, the outlet valve 445 is closed and liquid flows into variable volume mixing chamber 421 through first liquid inlet valve 402 and second liquid inlet valve 404. First liquid inlet valve 402 and second liquid inlet valve 404 may be sized differently to allow different volumes of first and second liquids to flow into variable volume mixing chamber 421, or be sized differently to allow the same amount of the two liquids to flow into the variable volume mixing chamber 421 even though the two liquids may have different viscosities. As described above, once the two liquids begin to mix, the mixture begins to form a foam.

The actuator 406 then moves upward causing the variable volume mixing chamber 421 to compress and force the foamy mixture to pass through the baffles 460 in the outlet nozzle 424, which violently mixes the foamy mixture causing more foam to form, and the foam is forced through the outlet valve 445 and is dispensed out of the nozzle outlet 426.

Figure 5:
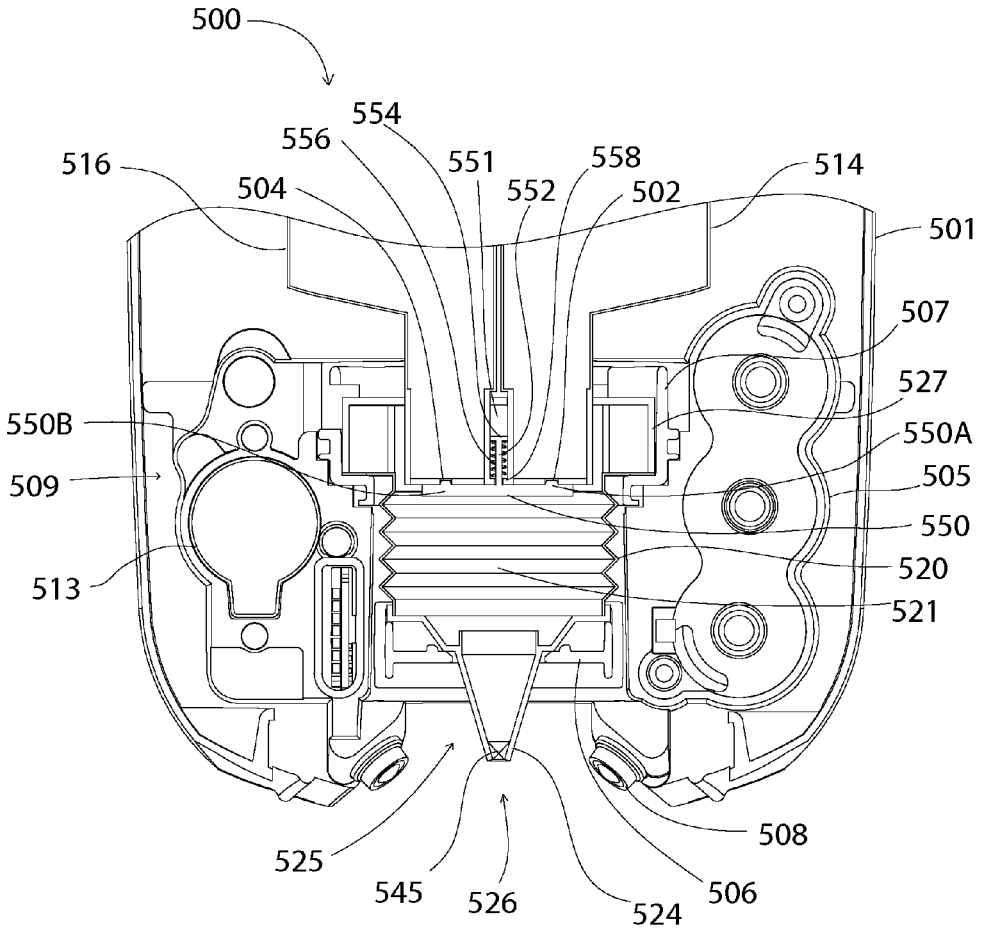
FIG. 5 is an enlarged cross-sectional view of another exemplary dispensing system and refill unit.

FIG. 5 is an enlarged cross-sectional view of another embodiment of a dispensing system 500. Dispensing system 500 is similar to dispensing systems 200 and 400 and may be used in a similar dispenser with minor modifications. Dispensing system 500 includes a housing 501, a holder 507 for holding a refill unit, a power supply 505, a sensor 508 for sensing an object, a motor 513 and associated gearing, an actuator 506 and circuitry 509 for determining whether an object is present and for causing the motor 513 to operate actuator 506 to dispense a dose of the mixture of two or more liquids. As discussed above, holder 507 may include a means, such as for example, a rotatable lock ring, for securing a refill unit 510 to dispenser housing 501.

A refill unit 510 is inserted in dispensing system 500. Refill unit 510 includes a first container 514, a second container 516, a flexible membrane 520 and an outlet nozzle 524. In some embodiments, flexible membrane 520 is in the form of a bellows. In some embodiments, the flexible membrane 520 forms a conical shape or a tapered shaped bellows as illustrated in FIG. 4.

A variable volume mixing chamber 521 is formed at least in part by flexible membrane 520. In addition, located between first container 514 and variable volume mixing chamber 521 is a liquid inlet 502. Similarly, located between second container 516 and variable volume mixing chamber 521 is liquid inlet 504. Located between first container 514 and second container 516 is a void 551 and one or more projections 558. A liquid inlet valve 550 having a first portion 550A and a second portion 550B regulates flow of liquid from first container 514 through liquid inlet 502 and second container 516 through liquid inlet 504 into variable volume mixing chamber 521.

In one embodiment, inlet valve 550 includes a stem 552 with an annular stem projection 554 which fits within void 551. A spring 556, or other biasing member fits around stem 552 and operates against the one or more projections 558 and annular stem projection 554 to bias first liquid inlet valve portion 550A and second liquid inlet valve portion 550B to a closed position to seal off liquid inlets 502, 504 of containers 514, 516 (respectively) from variable volume mixing chamber 521. When variable volume mixing chamber 521 is under vacuum pressure, inlet valve 550 (including first portion 550A and second portion 550B) moves away from inlet openings 502, 504 to allow liquid to flow into the variable volume mixing chamber 521. In some embodiments inlet valve 550 (including first portion 550A and second portion 550B) are formed of a single unitary piece. In some embodiments first portion 550A and second portion 550B are linked together to form inlet valve 550.

Secured to flexible membrane 520 is outlet nozzle 524. Outlet nozzle 524 includes a conical outlet portion 525. In some embodiments, the conical outlet portion 525 includes one or more baffles (not shown) that cause turbulence to the liquid passing through and vigorously mix the two or more liquids. In addition, outlet nozzle 524 includes a one-way outlet check valve 545 located near the outlet 526.

During operation, if control circuitry 509 detects an object through sensor 508, the control circuitry 509 causes the motor 513 to move actuator 506 downward. As actuator 506 moves downward, variable volume mixing chamber 521 expands. Variable volume mixing chamber 521 may expand due to the bias caused by resiliency of the flexible membrane 520 (if for example it has a bellows shape), by an additional biasing member (not shown), or by securing the outlet nozzle 524 to the actuator 506.

As the variable volume mixing chamber 521 expands, the outlet valve 545 is closed and liquid flows into variable volume mixing chamber 521 through first liquid inlet 502 and second liquid inlet 504 because first portion 550A and second portion 550B of valve 550 move away from their respective inlets 502, 504. First liquid inlet 502 and second liquid inlet 504 may be sized differently to allow different volumes of first and second liquids to flow into variable volume mixing chamber 521, or may be sized differently to allow the same amount of the two liquids to flow into the variable volume mixing chamber 521 even though the two liquids have different viscosities. As described above, once the two liquids begin to mix, the mixture begins to form a foam.

The actuator 506 then moves upward causing the variable volume mixing chamber 521 to compress sealing off inlets 502 and 504 and forcing the foaming mixture to pass through outlet nozzle 524 and be dispensed out of the nozzle outlet 526.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A refill unit for a foam dispenser comprising:

a first container and a second container;

a first pump chamber associated with the first container and a second pump chamber associated with the second container;

the first and second pump chambers having a liquid inlet valve and a liquid outlet valve;

wherein expanding the first and second pump chambers draws liquid into the first and second pump chambers through the liquid inlet valves and compressing the first and second pump chambers forces liquid through the liquid outlet valves;

a mixing chamber located downstream of the liquid outlet valves;

the mixing chamber formed at least in part by a flexible membrane; and an outlet nozzle located downstream of the mixing chamber;

wherein the first pump chamber, the second pump chamber and the mixing chamber are compressed simultaneously.

2. The refill unit of claim 1 wherein the mixing chamber is in the form of a bellows.

3. The refill unit of claim 2 wherein the bellows has a tapered configuration, wherein a top portion of the bellows has an outside diameter that is greater than a bottom portion of the bellows.

4. The refill unit of claim 1 further comprising a first piston associated with the first pump chamber and a second piston associated with the second pump chamber, wherein movement of the first and second pistons compress the first and second pump chambers.

5. The refill unit of claim 1 wherein at least two outlet valves are positioned so that a liquid stream flowing out of the first pump chamber is directed toward a liquid stream flowing out of the second pump chamber.

6. The refill unit of claim 1 further comprising a drip catcher located at least partially within the mixing chamber.

7. The refill unit of claim 1 further comprising one or more baffles located within the outlet nozzle.

8. The refill unit of claim 1 further comprising a biasing member to expand the volume of the mixing chamber.

9. The refill unit of claim 8 wherein the biasing member is the flexible membrane of the mixing chamber.

* * * * *